United States Patent [19]

Nicollet

[11] 3,964,472

[45] June 22, 1976

[54] AUTOMATIC DEVICE FOR SUBAQUEOUS MASSAGE

[76] Inventor: Michel Nicollet, 6, rue Oberlin, Strasbourg, (Bas-Rhin), France

[22] Filed: Mar. 20, 1974

[21] Appl. No.: 452,840

[30] Foreign Application Priority Data

Mar. 20, 1973 France ..... 73.11007

[52] U.S. Cl. ..... 128/66

[51] Int. Cl.[2] ..... A61H 9/00

[58] Field of Search ..... 128/66; 4/178, 180

[56] References Cited

UNITED STATES PATENTS

| | | | |
|---|---|---|---|
| 3,043,296 | 7/1962 | Gregory | 128/66 |
| 3,297,025 | 1/1967 | Jacuzzi | 128/66 |
| 3,374,492 | 3/1968 | Ruderian | 4/178 |
| 3,467,969 | 9/1969 | Szekely | 4/180 |
| 3,736,924 | 6/1973 | Jacuzzi et al. | 128/66 |
| 3,797,482 | 3/1974 | Nicollet | 128/66 |

*Primary Examiner*—Lawrence W. Trapp
*Attorney, Agent, or Firm*—Young & Thompson

[57] ABSTRACT

A tub for subaqueous massage has a bottom that is upwardly convex in the region of the lower limbs and upwardly concave in the region of the hips and back. Armrests are provided, and a divider between the legs. Inlets for mixed air and water are provided on the sides and on the bottom and on the divider. The inlets are recessed either in individual recesses or in grooves common to a plurality of inlets. Air under pressures entrains the water, or vice versa. Individual valves are provided for selectively actuating the water and/or air in a plurality of regions of the tube thereby to select the regions of the body to be treated.

15 Claims, 7 Drawing Figures

AUTOMATIC DEVICE FOR SUBAQUEOUS MASSAGE

The present invention relates to devices for subaqueous massage, of the general type of my earlier U.S. Pat. No. 3,797,482, Mar. 19, 1974.

Such devices comprise massage pools in the form of baths fitted with water jets, to perform underwater massage automatically, for therapeutical purposes, and also on persons in good health.

So called "whirlpool" baths are already known, in which the water circulates in a closed circuit with the help of a motorized pump and is returned to the tub by means of nozzles or perforated pipes to create water currents in the bath. Such devices, however, cannot perform a genuine massage and are incapable of precise application to the body. This is due in part to the shape of the existing pools, which does not differ substantially from that of existing domestic bathtubs, and in part to the arrangement and orientation of the water jets. As a result, the water in such known baths is agitated with random turbulence and is not accurately applied to the body.

The present invention overcomes the drawbacks of known devices, and further advances the subject matter treated by my above-identified patent, by providing a device which automatically delivers water and air in admixture in jets arranged in a tub specially shaped to relax the user at the same time that it accurately positions the body of the user, the jets being directed in the direction of the venous circulation, that is, toward the heart. The jets are individually connected to sources of water and/or air under pressure, the driving fluid being alternatively the water or the air, there being valves provided for selectively actuating and deactuating the various jets or groups of jets thereby selectively to treat different portions of the body.

Other features of the invention will become apparent from a consideration of the following description, taken in connection with the accompanying drawings, in which.

Figure 2:
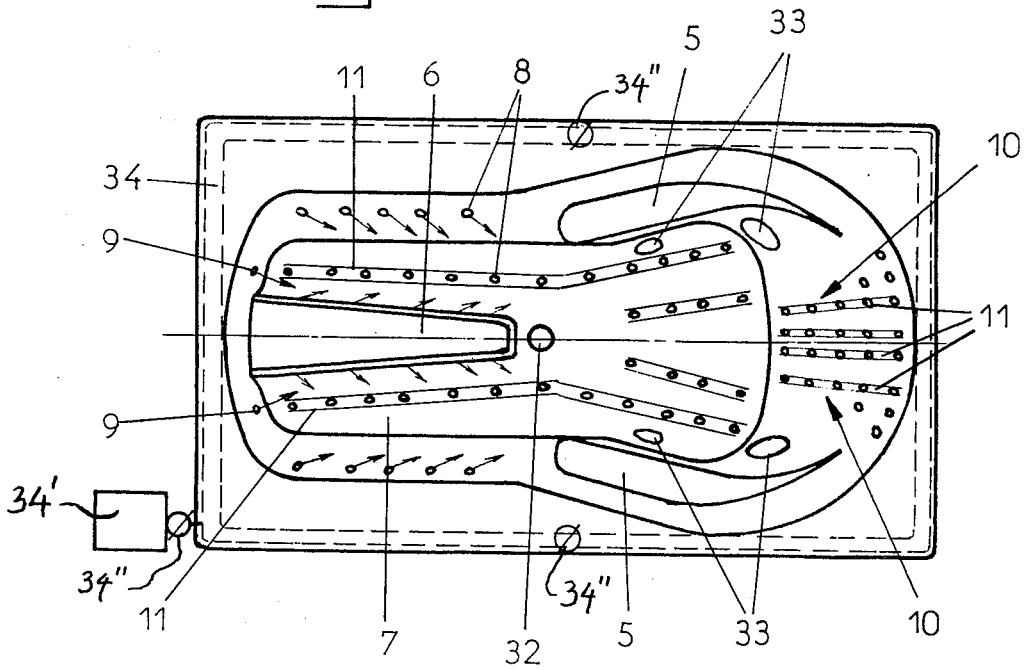
FIG. 2 is a top plan view thereof.

Referring now to the drawings in greater detail, there is shown a device according to the present invention, comprising a tub 1 which is specially shaped to place the user in the most favorable position to receive underwater massage, that is to say, in a relaxed position. To this end, the tub bottom has a double curve: upwardly convex at 2 for the reception of the lower limbs, and upwardly concave at 3 for the reception of the hips and the lower back, the upper back being supported at 4. Armrests 5 are provided, the portion 5, 4, 5 of the bath being generally horseshoe shaped as seen in FIG. 2, so as to flex the arms and shoulders and place them in a relaxed posture. Armrests 5 slope somewhat downwardly toward the head end of the tub.

A divider 6 extends between the lower limbs of the user and can, like the rest of the tub, be made of metal or molded plastic. The walls of the divider, as well as the side walls and bottom walls of the rest of the tub, are provided with a multiplicity of jets or emitting orifices 8 which are supplied both with water and with air. The orifices 8 are arranged in lines extending generally lengthwise of the body of the user, the axes of the orifices being directed at angles not more than 70° to the lengthwise extent of the tub, and in the direction of venous circulation, that is, toward the heart.

Figure 4:
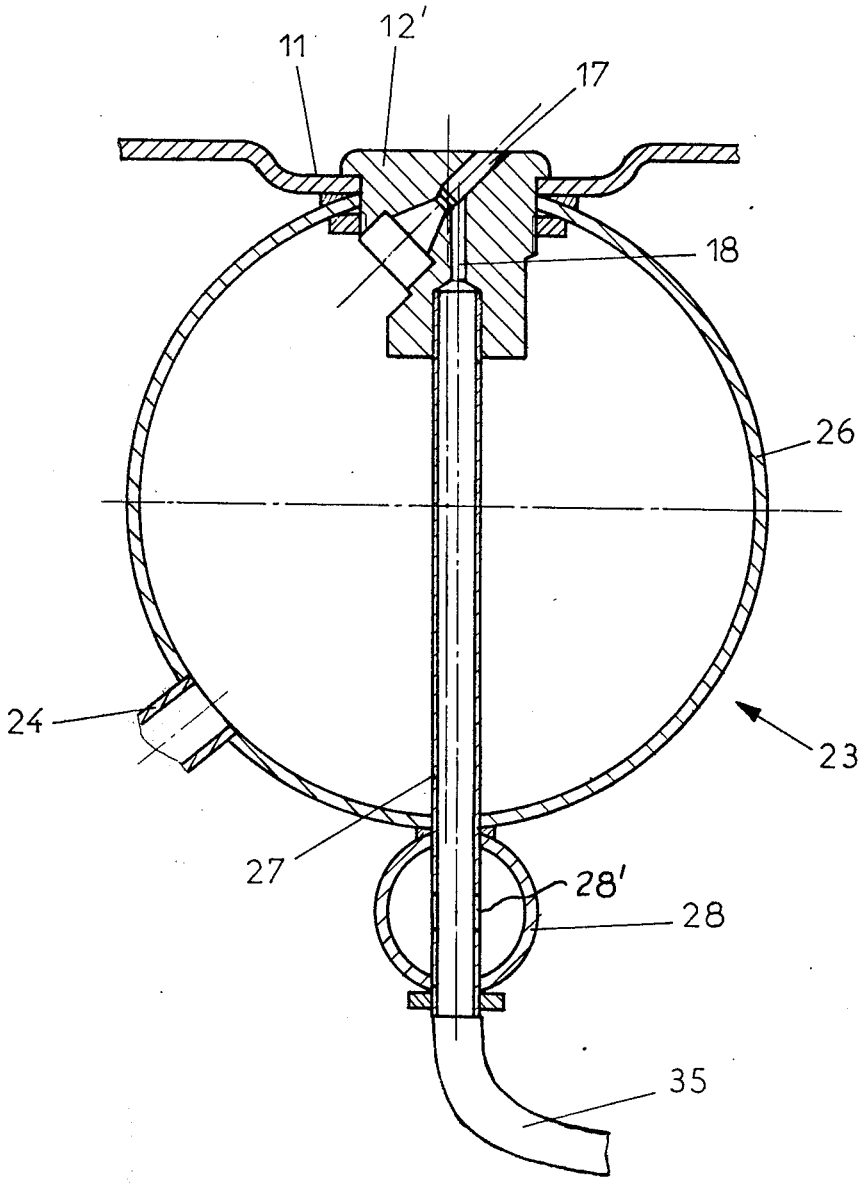
FIG. 4 is an enlarged cross-sectional view of an injection nozzle for a mixed air-water jet.

FIG. 4 shows an orifice in greater detail, in which compressed air is fed through a flexible conduit 35 to a rigid conduit 27 that terminates in a nozzle 12', the air inlet being restricted at 18. Downstream of restriction 18 is a liquid inlet that forms with the axis of the air inlet an angle of 90° or less in the direction of flow of the air, so that the air educts water from manifold 23 comprising a water pipe 26 common to a plurality of orifices and fed by a water inlet pipe 24. The air-water mixture leaves through the outlet opening 17, the orifice thus provided being disposed in a recess 11 in the tub bottom or side. This recess 11 can be a recess individual to a single orifice, or can be a groove or channel common to a line of orifices and disposed in a direction generally lengthwise of the tub.

Figure 5:
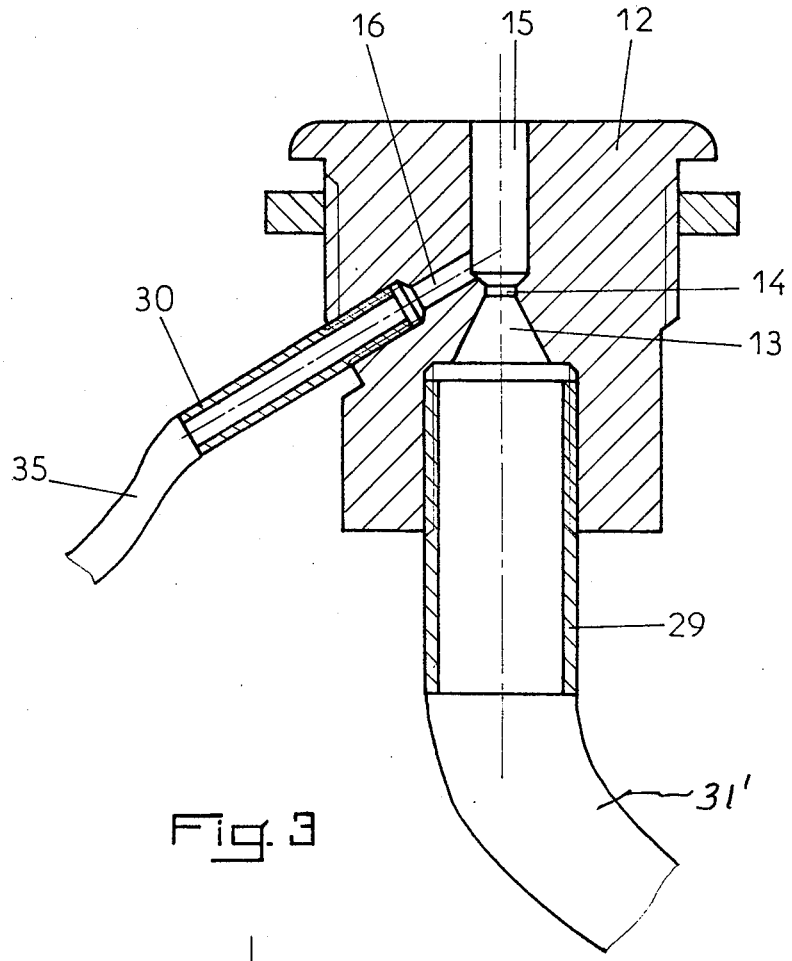
FIG. 5 is a view similar to FIG. 4 but showing an alternative embodiment in which the air and water are reversed.

FIG. 5 shows a variation in which the water is the driving fluid and enters nozzle 12 through an inlet 29, through a conical portion 13 and through a restricted portion 14 into an enlarged chamber 15 in which air is educted through channel 16 from inlet 30 supplied by a flexible conduit 35.

Figure 6:
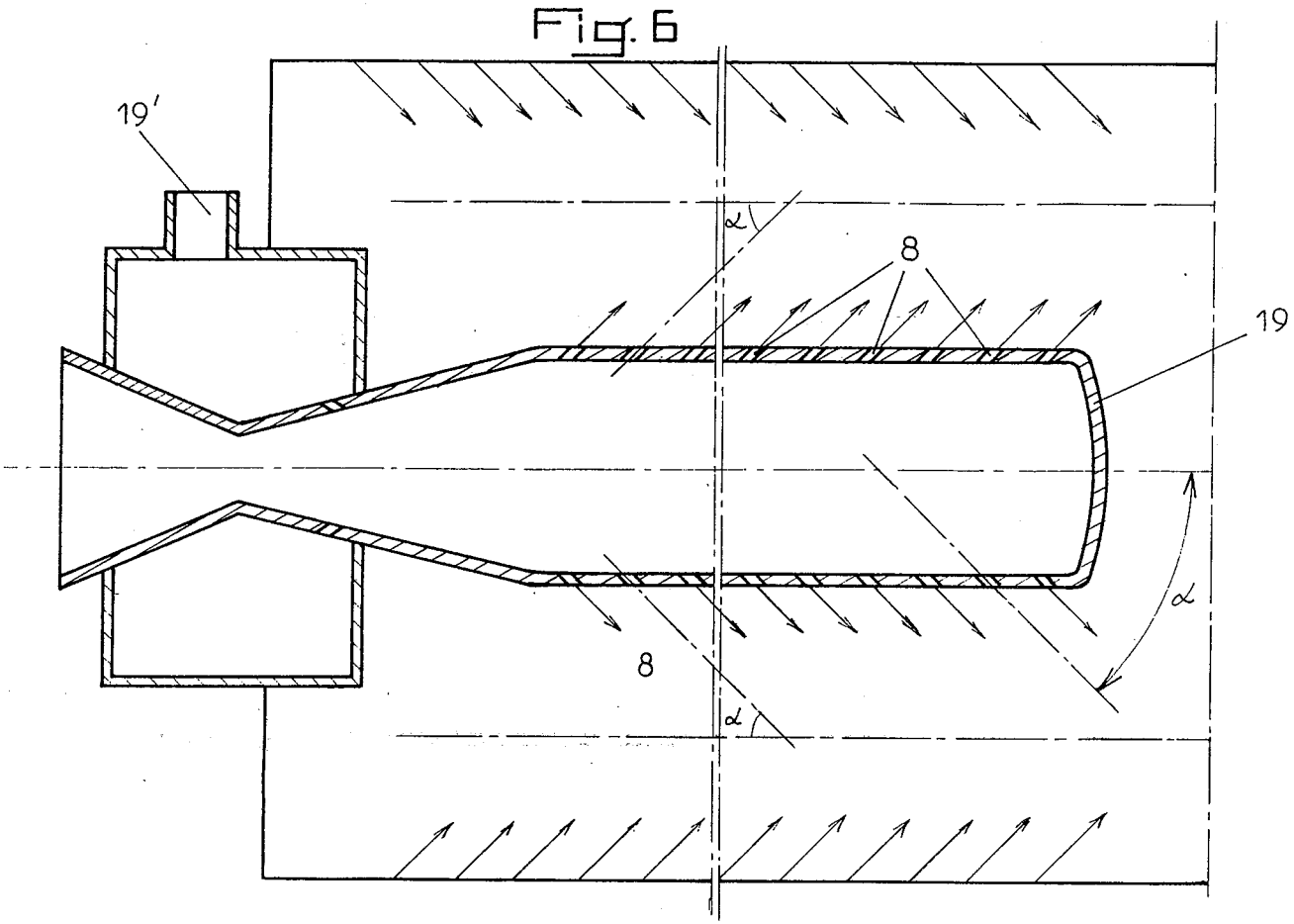
FIG. 6 is an enlarged fragmentary cross-sectional view of a modified construction for applying jets to the lower limbs.

FIG. 6 shows a variant in which the divider 6 is replaced by a closed end tube 19, this tube serving as a divider and having a constructed inlet end surrounded by an air manifold 19' from which air is educted by the water so as to emit an air-water mixture from the orifices 8.

It will be understood that the obliquity of the orifices 8 can also be achieved by forming the wall that they traverse of zig-zag or sawtooth cross-sectional configuration, so that the orifices 8 open through their associated wall at a right angle thereto but are nevertheless obliquely inclined to the longitudinal axis of the tub.

Figure 1:
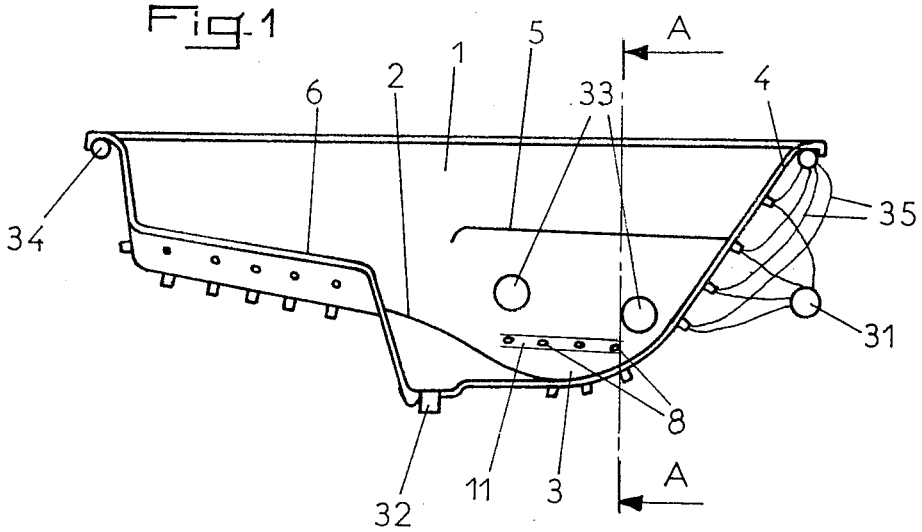
FIG. 1 is a side cross-sectional view of a device according to the present invention.
Figure 3:
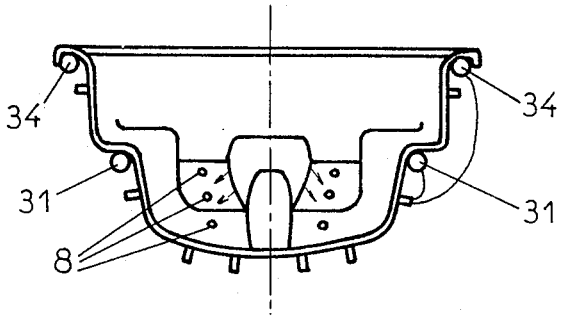
FIG. 3 is a cross section taken on the line A—A of FIG. 1.
Figure 7:
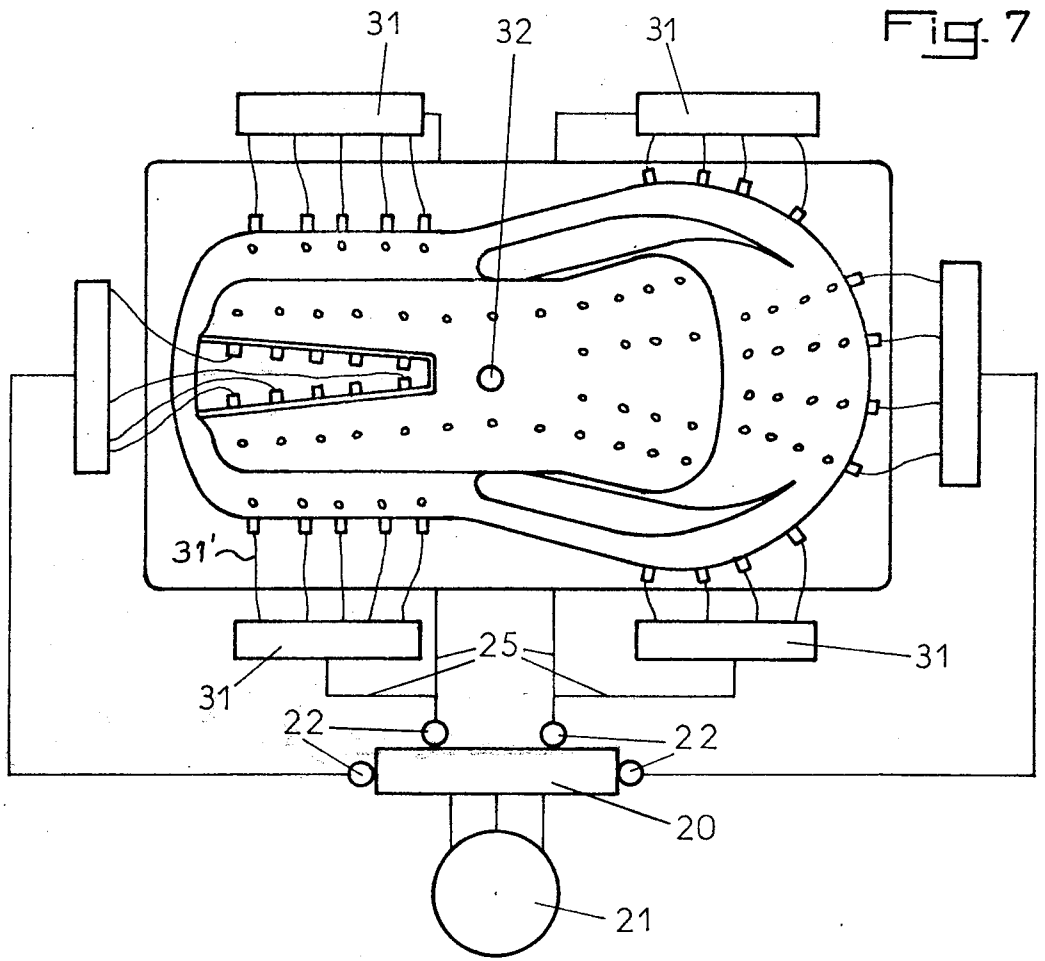
FIG. 7 is a somewhat schematic view of the water supply circuit of the present invention.

The circulation of the air and water according to the present invention will be better understood from a consideration of FIG. 7, taken also in connection with parts of FIGS. 1–3. As will there be seen, a water manifold 20 is fed by pump 21, the water from the manifold 20 being distributed selectively by individually operable valves 22, to a plurality of conduits 25 from which separate manifolds 31 are supplied, each manifold 31 supplying water to a plurality of water supply conduits such as the flexible conduits 31' of FIG. 5.

Water drains are provided at 32 and 33, their positions as shown in FIGS. 1 and 2 also being important from the standpoint of promoting such circulation of the water in the tub as will be of maximum therapeutic value.

The air supply is from a manifold 34 that encompasses the tub just under the rim thereof, the manifold 34 being supplied with air from an air pump 34', the air flow being controlled by individually operated valves 34''. An alternative air supply is shown in FIG. 4, in which a rigid conduit 28 supplies air to conduit 27 through openings 28'.

Means for the manual selection of the air and the water supply to different portions of the user's body are thus provided. However, instead of manual actuation, the selection could be effected mechanically or electrically or pneumatically, as for example by any type of well known motorized device embodying a cam selector or a magnetic tape selector or other automatic control. But whether manually or automatically, means are thus provided for selecting the portion of the body of the user which is to be treated, for example the hips, or the lumbar region, or the sides of the legs, etc.

It will also be appreciated that, when air under pressure is the aspirating or educting medium, the supply of air alone at the end of the use of the device will have the effect of purging water from the device, that is, drying out the water conduits by eduction, so that water is not left therein and the opportunity for bacterial growth in retained water is reduced.

The use of air under pressure also has the advantage that the same supply system can be used to introduce ozone from a source of ozone (not shown), for the purpose of sterilizing the water that is used. This is important when water is recycled in the device.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

Having described my invention, I claim:

1. An automatic device for underwater massage, comprising a tub specially shaped to place a human body in a relaxing position, a motor-driven pump recycling water in a closed circuit in the tub through a dispatching system comprising a general water distributor manifold at the outlet of the pump, said manifold being connected to several secondary distributor manifolds, each of said secondary manifolds feeding water to several water outlets located in the walls of the tub.

2. A device as claimed in claim 1, having delivery valves disposed at the outlets of the general manifold or at the water inlets of the secondary distributor manifolds.

3. A device as claimed in claim 1, and a divider at the foot end of the tub and disposed between the legs of a user of the tub, said divider extending lengthwise of the tub, from the foot end toward but terminating short of the head end of the tub, said divider comprising a pipe closed at its forward end and having a plurality of jets in opposite side walls of said pipe.

4. A device as claimed in claim 1, and fluid outlet orifices placed, according to anatomical topography, lengthwise in rows in each side wall of the tub opposite to a median line extending all along the external part of each lower limb of a user, and under armrests, opposite to the hips, and in the bottom of the tub, opposite to posterior parts of the lower limbs and under the user's buttocks.

5. A device as claimed in claim 1, in which the axes of the fluid outlet orifices placed in the three faces of the two receiving lower limbs channels are inclined to the direction of the longitudinal axis of the tub, whereby water currents rise along the limbs of the user in the direction of venous circulation.

6. A device as claimed in claim 1, having a multiplicity of small cylindrical one-piece nozzles inserted in the walls of the tub, the body of the nozzles being bored right through by a piercing which consists in a conical water inlet conduit with a narrow portion followed by a cylindrical or slightly diverging conduit receiving an air vacuum constituted by a simple bore forming with the axis of said water conduit an angle no greater than 90°.

7. A device as claimed in claim 6, in which the water ejection conduit of the nozzle is oblique in relation to the air conduit which is parallel or at an acute angle to the axis of the nozzle.

8. A device as claimed in claim 1, in which the water conduits of the nozzles or outlet orifices open directly into a second distributor manifold which is constituted either by a second wall partially or totally lining the walls of the tub or by an outer pipe common to several nozzles.

9. A device as claimed in claim 8, in which the nozzles have an axially elongated air conduit passing through the secondary distributor manifold.

10. A device as claimed in claim 1, in which the secondary distributor manifold is itself a water-air blast nozzle constituted by a pipe having a water and an air inlet and a multiplicity of air-water outlet orifices disposed in at least one longitudinal row.

11. A device as claimed in claim 1, having bilateral vacuum orifices for returning water toward the pump, said bilateral orifices being located in the head end of the tub, under the armrests, and at the junction of the back part with the side walls of the tub.

12. A device as claimed in claim 6, comprising a general air distributor manifold common to all nozzles of the device and having an auxiliary air ventilator disposed at the air inlet of said distributor.

13. A device as claimed in claim 6, and an ozone-producing device located at the inlet orifice for the admission of air into the main air distributor manifold.

14. A device as claimed in claim 1, and an automatic program selector having means to control the action of delivery valves of the water dispatching system.

15. An automatic device for underwater massage comprising a tub adapted to receive the human body, the bottom of said tub, when viewed in side cross section, having an upwardly convex contour adjacent the foot end thereof and an upwardly concave contour adjacent the head end thereof, massaging elements emitting fluid jets and secured to the walls of the tub, means to supply water to said jets, and means to supply air to the same said jets.

* * * * *